US005742964A

United States Patent [19]

Choi

[11] Patent Number: 5,742,964

[45] Date of Patent: Apr. 28, 1998

[54] DOOR OPENING/CLOSING APPARATUS AND METHOD FOR A WASHING MACHINE

[75] Inventor: Ssi Chol Choi, Suwon, Rep. of Korea

[73] Assignee: Samsung Electronics Co., Ltd., Suwon, Rep. of Korea

[21] Appl. No.: 739,785

[22] Filed: Oct. 30, 1996

[30] Foreign Application Priority Data

Nov. 9, 1995 [KP] DPR of Korea ..... 95-40473

[51] Int. Cl.[6] ..... D06F 33/02; D06F 39/14

[52] U.S. Cl. ..... 8/159; 49/31; 68/12.26; 68/12.27; 68/196

[58] Field of Search ..... 8/159; 68/12.26, 68/12.27, 23 R, 196; 49/31

[56] References Cited

U.S. PATENT DOCUMENTS 4,510,777 4/1985 Ellingson t al. ..... 68/12.26

4,623,179 11/1986 Davis et al. ..... 68/12.26 X 4,866,955 9/1989 Blair et al. ..... 68/12.26 X 5,038,587 8/1991 Harmelink ..... 68/12.26

5,546,773 8/1996 Lee ..... 68/196

*Primary Examiner*—Philip R. Coe

*Attorney, Agent, or Firm*—Burns, Doane, Swecker & Mathis L.L.P.

[57] ABSTRACT

A novel apparatus and method for a washing machine wherein which the door may be automatically opened and closed. The door opening/closing apparatus comprises: a sensor for determining an opened state of the door; a sensor for determining a closed state of the door; a motor for supplying a dynamic force to open and close the door; an external input mechanism for entering a door opening/closing command; and a controller for determining the state of the door based on information supplied from each of the sensors when a door opening/closing command is present, and controlling the activation of the motor, accordingly.

18 Claims, 6 Drawing Sheets

FIG. 6

| | DOOR STATE | OPEN SENSOR | CLOSE SENSOR | DOOR MOTOR | BUZZER |
|---|---|---|---|---|---|
| 1 | OPEN | L(ON) | H(OFF) | CLOSING OPERATION | NO OPERATION |
| 2 | CLOSED | H(OFF) | L(ON) | CLOSING OPERATION | NO OPERATION |
| 3 | HALFWAY-CAUGHT | H(OFF) | H(OFF) | NO OPERATION | ERROR SOUND |
| 4 | SENSOR MALFUNCTION | L(ON) | L(ON) | NO OPERATION | ERROR SOUND |

DOOR OPENING/CLOSING APPARATUS AND METHOD FOR A WASHING MACHINE

BACKGROUND OF THE INVENTION

The present invention is related to an automatic door opening/closing apparatus and method adapted for use in a washing machine.

A conventional vertical shaft washing machine, i.e. pulsator washing machine, has an operable lid (hereinafter referred to as "door") which is located on an upper portion of a housing. The door is frequently opened and closed when loading laundry into or unloading laundry from the laundry tub, adding detergent or rinse, loading additional laundry, settling unbalanced loads, inspecting the advancement of washing procedure, or the like. Consequently, opening and closing of the door may occur frequently even during the execution of a single washing cycle.

A conventional door is inconvenient to operate because it is opened and closed manually. Moreover, a greater effort is required to open and close the door on a contemporary model as opposed to previous models because newer models are larger in size and have, accordingly, a larger and heavier door.

To solve the aforementioned problems, the object of the present invention is to provide a door opening/closing apparatus and method for a washing machine by which the door can automatically opened and closed by simple key operation.

SUMMARY OF THE INVENTION

A novel door opening/closing apparatus for a washing machine comprises: a door for the laundry tub of the washing machine; means for sensing the opened state of the door; means for sensing the closed state of the door; means for supplying the dynamic force required to open and close the door; means triggered by an external key operation for producing a door opening/closing demand; and means for judging the state of the door on the basis of the information supplied from each of the sensing means when a door opening/closing demand is present, and controlling activation of the force supplying means based on the result of the judgement.

A door opening/closing method, according to the present invention, for automatically opening and closing the door by a motor, comprises: the steps of judging whether or not a door opening/closing demand is present determining whether one of an opened and closed state of the door is indicated when the door opening or closing demand is present; closing the door by driving the motor in the case where the door opening/closing demand is present, and wherein the door open state is sensed and the door closed state is not sensed; and opening the door by driving the motor in the case where the door opening/closing demand is present, and wherein the door open state is not sensed and the door closed state is sensed.

BRIEF DESCRIPTION OF THE DRAWINGS

Further objects and advantages of the present invention can be more fully understood from the following detailed description taken in conjunction with the accompanying drawings in which.

DETAILED DESCRIPTION OF THE PREFERRED EMBODIMENTS

Hereinafter, a preferred embodiment according to the present invention will be described in detail.

Figure 1:
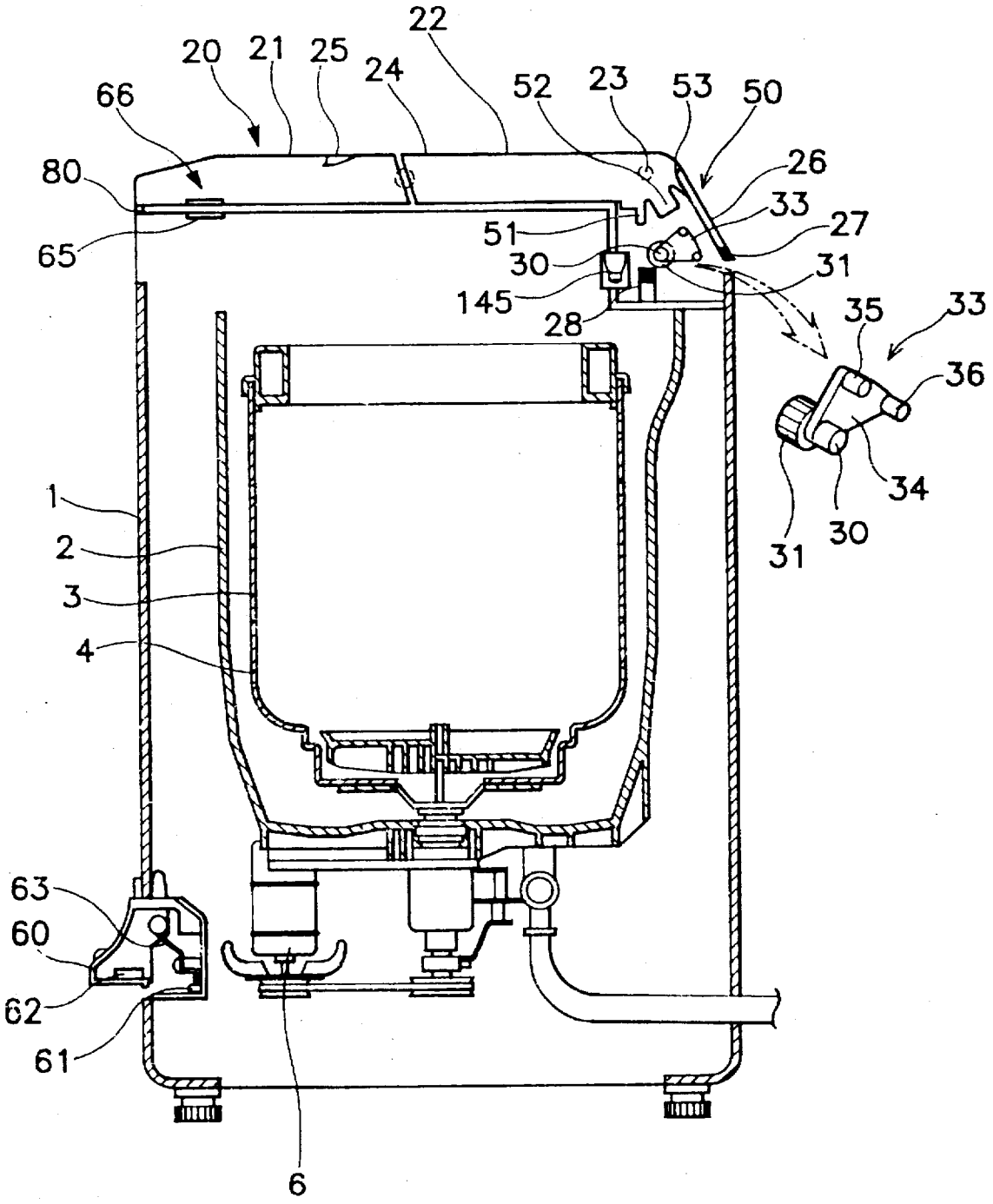
FIG. 1 is a longitudinal sectional view depicting a washing machine having a door opening/closing apparatus according to the present invention.

FIG. 1 is a longitudinal sectional view depicting a washing machine having a door opening/closing apparatus according to the present invention. A washing machine having the novel door opening/closing apparatus includes a water tub 2 formed of a cylindrical body is located in an outer casing 1. A laundry tub 3 having a multiplicity of holes for providing water communication with the water tub 2, the laundry tub 3 being rotatably mounted in the water tub 2. A door 20 for giving access to the laundry tub 3 is mounted on the upper portion of the outer casing 1, and consists of two parts: a front half member 21 and a rear half member 22.

The rear half member 22 is pivotally connected to a first hinge 23 mounted to a rear portion of the outer casing 1. The rear end of the front half member 21 is pivotally coupled with a front end of the rear half member 22 by a second hinge 24. Accordingly, when the door 20 is opened, the front end of the front half member 21 moves toward the rear end of the rear half member 22.

A driving/rotating means 30 for rotating the door 20 in a clockwise or counter-clockwise direction about an axis defined by the first hinge 23 is located below the first hinge 23. The driving/rotating means 30 largely consists of a door motor 31 for supplying dynamic force to the door 20 and a rotary member 33 coupled to the shaft of the door motor 31. The rotary member 33 consists of a wedge-shaped rotary plate 34 having first and second bosses 35, 36 protruding from a surface thereof at outer edges of the rotary plate 34.

A cam member 50 is provided near the first hinge 23 in the rear portion of the second half member 22, and consists of first through third teeth 51–53. When the rotary member 33 rotates according to the forward or reverse rotation of the door motor 31 (hereinafter the direction that opens the door 20 is defined as the forward rotation), the first through third teeth 51–53 sequentially engage the first and second bosses 35, 36, thereby applying rotational torque to the first through third teeth 51–53.

A sensor for detecting the opening of the door 20, which is preferably embodied as a waterproof reed switch 28, is located at a position in a rear portion of the outer casing 1. A permanent magnet 27 is fixed to a lever 26 extending from the second half member 22. A contact point of the reed switch 28 is closed by the magnetic force of the permanent magnet 27 when the door 20 opens to an extent corresponding to "full opening".

A sensor for detecting the closing of the door 20, which is also preferably embodied by a waterproof reed switch 65, is located at a front upper portion of the outer casing 1.

A permanent magnet 66 is fastened to the first half member 21 opposite the reed switch 65. The contact point of the reed switch 65 is closed by the magnetic force of the permanent magnet 66 when the door 20 closes to the extent corresponding to "full closing".

A switch for issuing a door opening/closing order, which is preferably embodied by a waterproof reed switch 61, is located at the front and lower portion of the outer casing 1. The contact point of the reed switch 61 closes by the magnetic force of a permanent magnet 62 secured to a pedal 60. The tension force of a leaf spring 63 maintains the pedal in the released state, which corresponds to the open position of the reed switch 61. The depression of the pedal 60 by the user causes the permanent magnet 62 to approach the reed switch 61, resulting in the closing thereof.

Reference number 25 denotes a handle used for the manual opening and closing of the door 20, 80 denotes a roller for the smooth opening and closing operation of the door 20, and 6 denotes a wash motor.

The mounting positions and structures of the sensor 28 for door opening, the sensor 65 for door closing, and the open/close switch 61 may be freely modified within the spirit and scope of the invention. For example, the open/close switch may be located at a position operable by hand instead of a position operable by foot. In this case, it may be arranged together with other function keys in a control panel(not shown) located at a front and upper portion of the outer casing 1.

Furthermore, taking into consideration moisture as an inevitable property of a washing machine, the sensor 28 for door opening, the sensor 65 for door closing and the open/close switch 61 are all preferably embodied as waterproof reed switches. However, each of them may alternatively be embodied as other common switches whose contact points open and close by mechanical force.

Figure 2C:
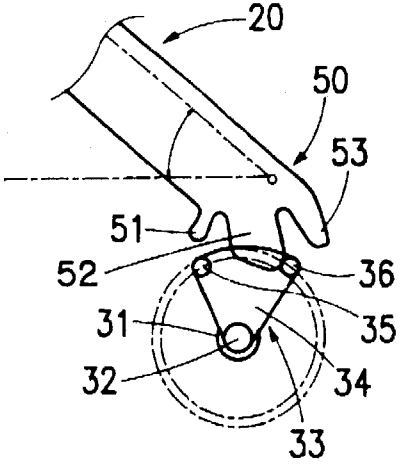
FIGS. 2(A) through 2(E) are partial views showing successive phases of the door opening and closing operation according to the present invention.
Figure 2B:
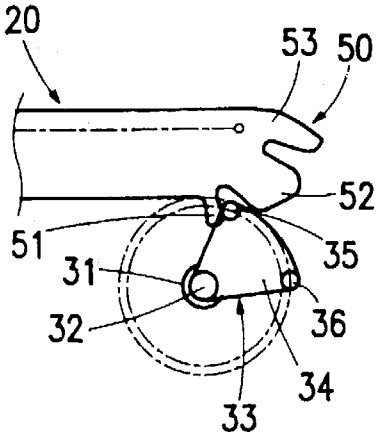
Figure 2A:
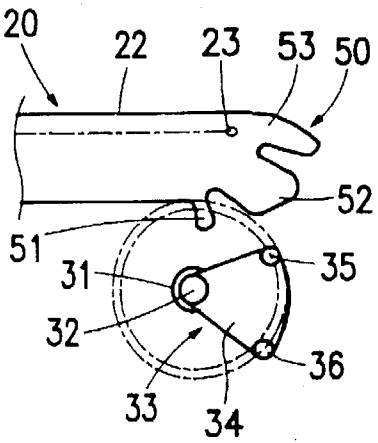

FIGS. 2(A) through 2(E) are partial views depicting successive phases of a door opening and closing operation according to the present invention. As shown in FIG. 2(A), when the door 20 is in the "full closing" state, both the first and second bosses 35, 36 are not within the rotating radius of the first through third teeth 51–53. Consequently, the door 20 may open or closed by hand.

Figure 2E:
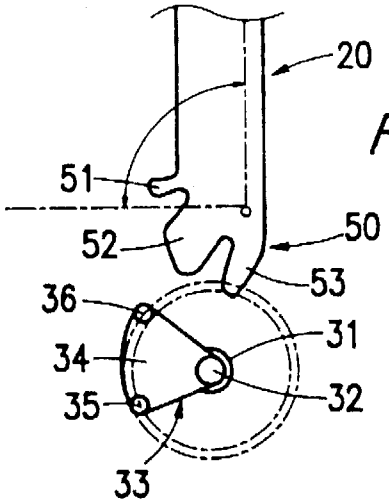

If an automatic opening demand is issued (i.e. the user depresses the pedal 60), the door motor 31 is driven so that the rotary plate 34 is rotated forward. In succession, the first boss 35 and second boss 36 engage the grooves formed between the first and second teeth 51,52 and second and third teeth 52,53, respectively. This event, as depicted in FIGS. 2(B) and 2(C), causes the front portion of the rear half member 22 to rise. The rear half member rotates to a 90 degree angle as the first and second bosses 35,36 sequentially disengage from their respective grooves with the continued rotation of the rotary plate 34 (FIG. 2(D). Power to the door motor 31 is discontinued before the door achieves the fully opened position, but the motor's momentum continues to rotate the rotary plate 34 until it comes to rest in its position as shown in FIG. 2(E). In the fully opened position, as with the fully closed position, the first and second bosses 35,36 are not within the rotating radius of the first through third teeth 51–53. This allows operation of the door by hand.

Figure 2D:
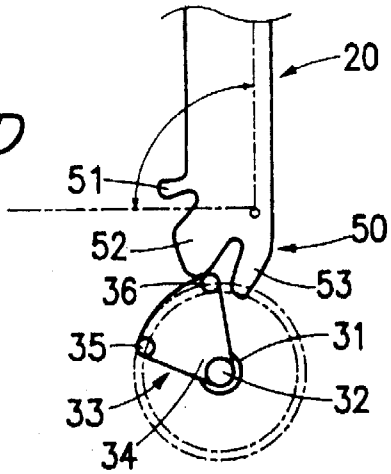

The automatic door closing operation is reverse to that of the door opening operation. That is, if the user depresses the pedal 60, the door motor 31 is driven so that the rotary plate 34 rotates in the reverse direction. This causes the second boss 36 to be engaged with the third tooth 53 as shown in FIG. 2(D), lowering the front half of the rear member 22. As the rotary plate 34 and the rear member 22 rotate, the first boss 35 is engaged with and then disengaged from the second tooth 52 as shown in FIGS. 2(C) and 2(B). After the door 20 fully closes by thus mechanism, the first boss 35 disengages from the second tooth 52. The driving of the door motor 31 stops before the full closing of the door 20, while the rotary plate 34 comes to rest in its position in FIG. 2(A) after rotating by the inertia of the door motor 31.

Figure 3:
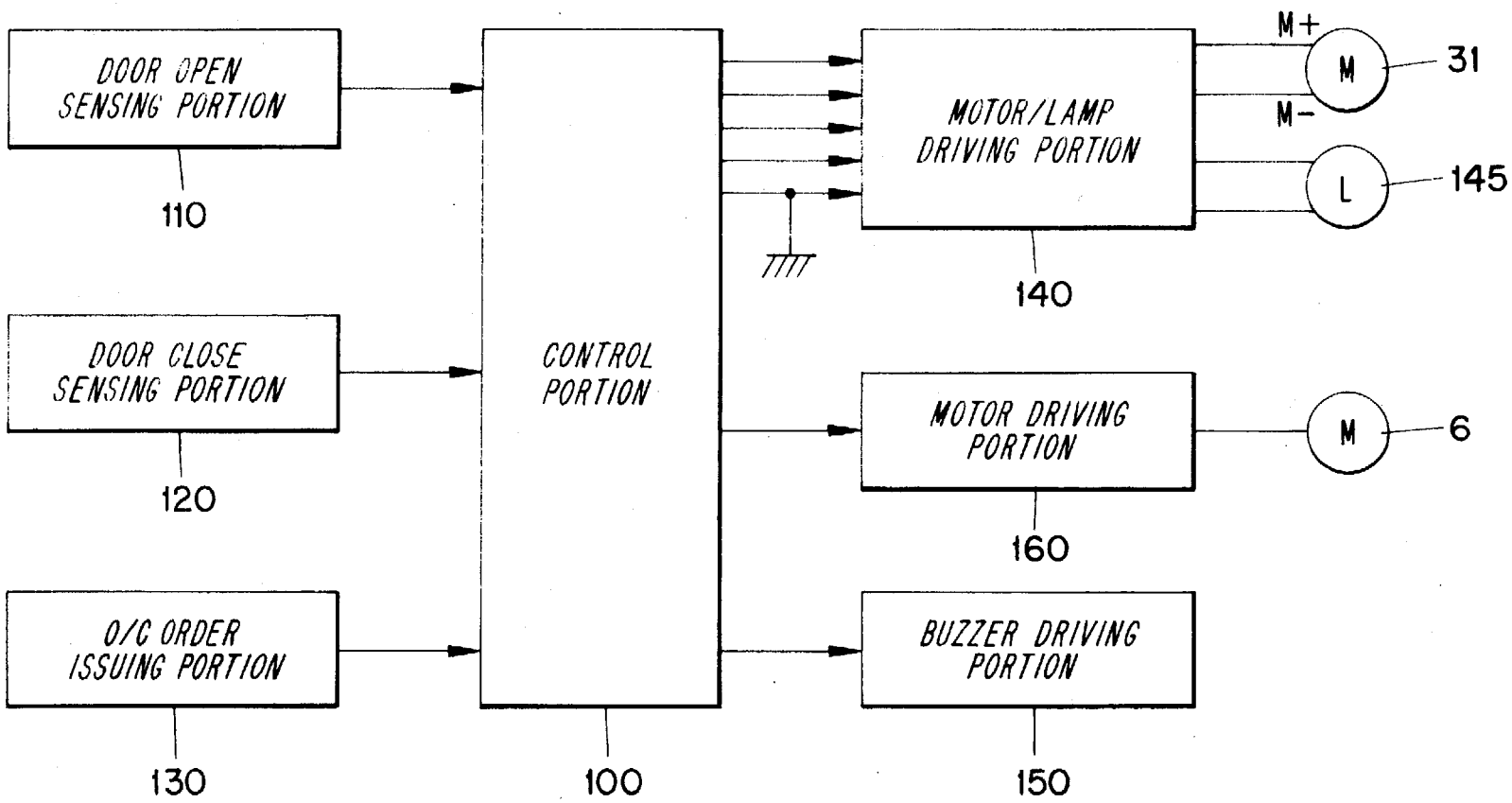
FIG. 3 is a control block diagram for a door opening/closing apparatus according to the present invention.
Figure 4:
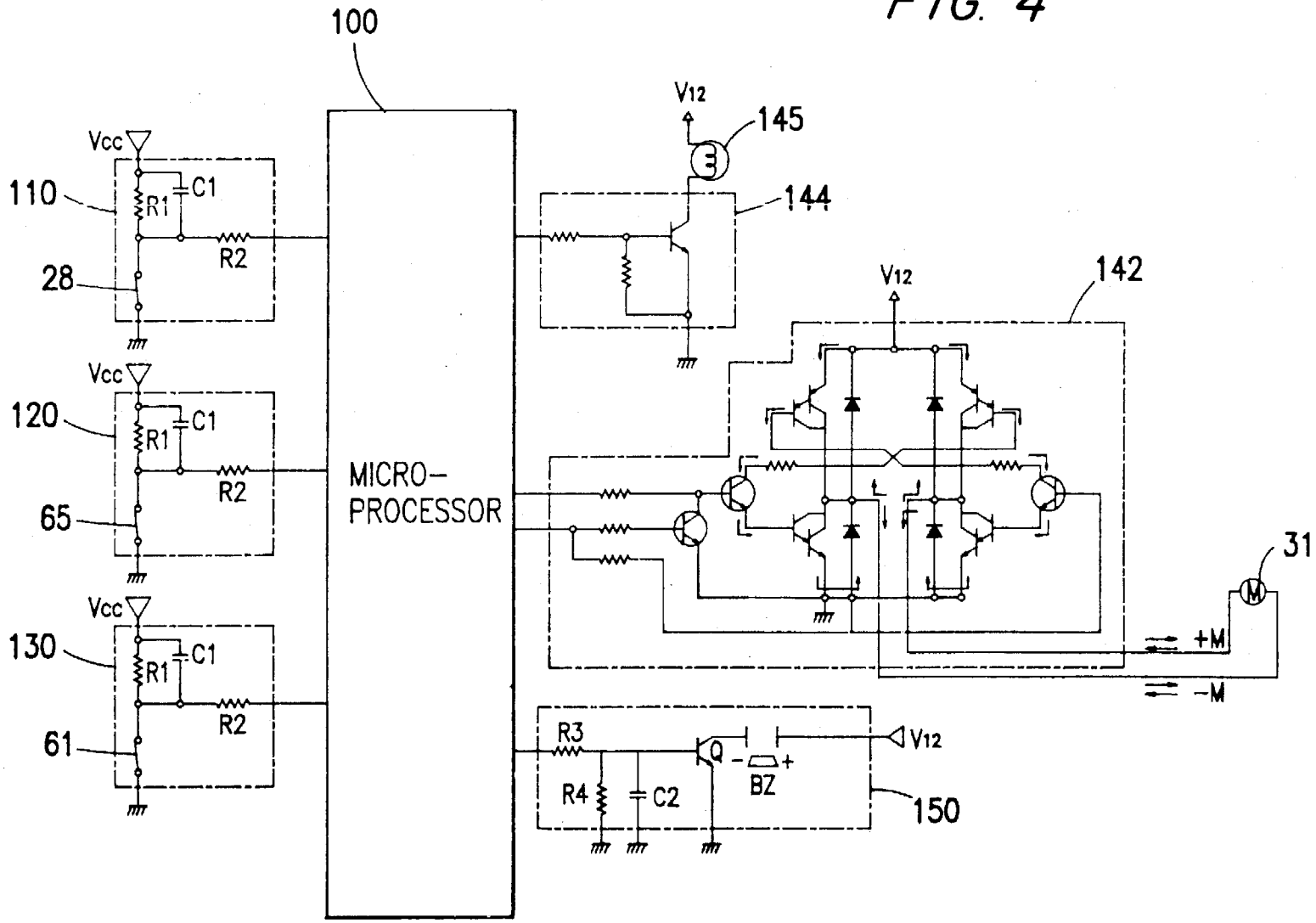
FIG. 4 is a circuit diagram of that shown in FIG. 3.

FIG. 3 is a control block diagram for a door opening/closing apparatus according to the present invention, and FIG. 4 is a circuit diagram of the control block shown in FIG. 3. As shown in FIGS. 3 and 4, the electrical configuration of the novel door opening/closing apparatus largely consists of a portion 130 for issuing door opening and closing orders; a portion 110 for sensing the opening of the door 20; a portion 120 for sensing the closing of the door 20; the door motor 31 for providing dynamic force to move the door 20; a portion 142 for driving the door motor 31; a buzzer-driving portion 150 for issuing an error sound when the door 20 malfunctions; and a control portion 100 for determining the present state of the door 20 on the basis of information provided from the sensing portions 110 and 120 when the order issuing portion 130 issues either opening or closing orders, and then for executing necessary controls.

In the aforementioned configuration, the control portion 100 is preferably embodied as a microprocessor having the necessary control program. However, the control portion 100 may be alternatively embodied in a hardware configuration.

The sensing portions 110, 120 and order-issuing portion 130 comprise reed switches 28, 65, 61, respectively; resisters R1; condensers C1 for absorbing unwanted noise, and current-limiting resisters R2. The buzzer-driving portion 150 comprises resisters R3, R4, condenser C2, drive transistor Q1 and buzzer BZ. The door motor 31 is preferably embodied as a geared D.C. motor that rotates bidirectionally at a slow speed and with high torque. The motor-driving portion 142 comprises several resisters, diodes and transistors. In the motor-driving portion 142, a closed circuit, represented by solid-lined arrows, is formed in order to open the door 20, by rotating the door motor 31 forwards. On the other hand, to close the door 20, the closed circuit represented by dotted-lined arrows is formed, thereby rotating the door motor 31 reversely.

Reference numeral 145 and 144 denote a lamp for illuminating an interior of the laundry tub 3, and a lamp driving portion thereof, respectively. Reference numeral 160 denotes a portion for driving the wash motor 6 which rotates the laundry tub at a high speed during dehydration steps.

For the sake of user's safety, conventional washing machines immediately interrupt driving the wash motor 6 if the door 20 even slightly opened during dehydration steps. In order to make this function possible, a conventional washing machine has a means for sensing the closed state of the door 20. By using this existing closed door-sensing means as the sensing portion 120 required for the present invention, it is possible to cut down on production cost.

Hereinafter, the operation of the present invention will be explained in conjunction with a door opening/closing method.

Figure 5:
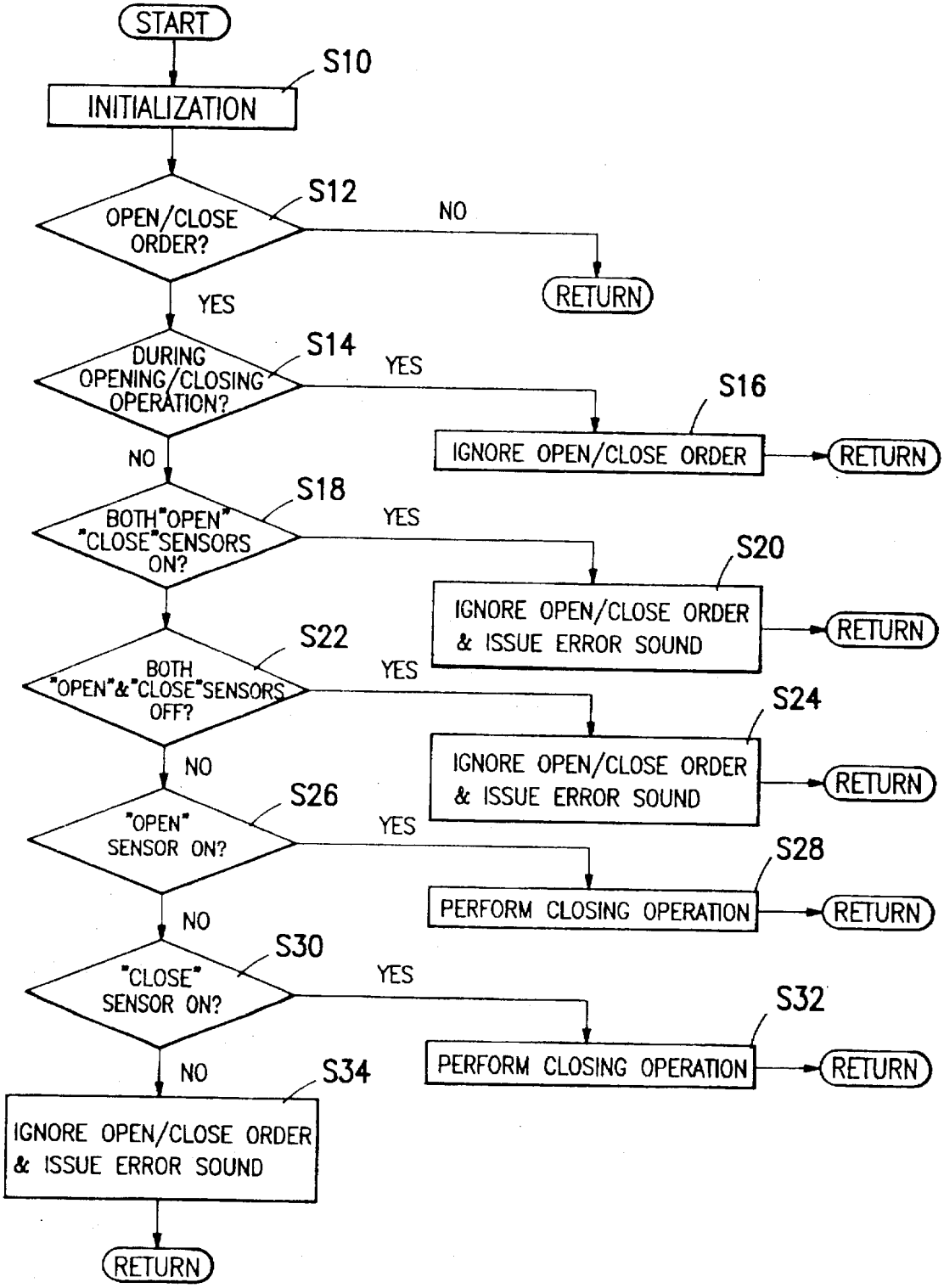
FIG. 5 is a flow chart illustrating a door opening/closing method according to the present invention; and, FIG. 6 is a table explaining the door opening and closing operations according to the outputs of each sensor.

FIG. 5 is a flow chart illustrating a door opening/closing method according to the present invention, and is executed by the microprocessor 100. FIG. 6 is a table detailing the door opening and closing operations according to outputs of each sensor.

Referring to FIG. 5, initialization is performed in step S10 when electric power is supplied to the washing machine. In step S12, the control portion 100 determines whether or not a door opening/closing demand exists. The depression of the pedal 60 closes the contact point of the reed switch 61, which creates a low-level voltage signal that is sent to the related input terminal of the control portion 100 (hereinafter called the microprocessor). During S12, this signal is interpreted by the microprocessor as an opening/closing demand.

If the door opening/closing demand exists at step S12, the program proceeds to step S14, where the microprocessor 100 determines whether or not door opening/closing is presently occurring. If door opening/closing is in operation at step S14, the program proceeds to step S16, where the micro processor 100 ignores the door opening/closing demand.

If door opening/closing is not in operation at step S14, the program proceeds to step S18, where the microprocessor 100 determines whether both the contact points of the reed switch 28(hereinafter called an open sensor) and the reed switch 65(hereinafter called a closed sensor) are closed ("on" state) or not. In the case where both the open sensor 28 and closed sensor 65 are on, the related input terminals of the micro processor 100 are receiving low-level voltages, and step S18 returns a "yes" value.

This situation(case 4, FIG. 6) occurs when there is a sensor malfunction, and the program proceeds to step S20 where an error sound is issued and the door motor 31 is not driven.

If at least one of the sensors 28, 65 is off during step S18, the program proceeds to step S22, where the microprocessor 100 determines whether both the open sensor 28 and closed sensor 65 are off. The case where both the open sensor 28 and closed sensor 65 are off (case 3 in FIG. 6) corresponds to the situation where the door 20 is between the opened and closed states. Accordingly, the program proceeds to step S24, where an error sound is issued and the door motor 31 is not driven.

If one of the sensors 28, 65 is on during step S22, the program proceeds to step S26, where the microprocessor 100 determines if the open sensor 28 is on (case 1, FIG. 6), which corresponds to the door 20 being fully open. If the step S26 returns a "yes" value the operation proceeds to step S28 where the door motor 31 is reversely driven until the open sensor 28 turns off and the closed sensor 65 turns on.

At step S30, the microprocessor 100 determines if the closed sensor 65 is on (case 2, FIG. 6), which corresponds to the door 20 being fully closed. If the step S30 returns a "yes" value, the program proceeds to step S32 where the door motor 31 is forwardly driven until the open sensor 28 is on and the closed sensor 65 is off.

If the closed sensor 65 is off during step S30, the program proceeds to step S34, where only an error sound is issued and the door motor 31 is not driven.

Heretofore, automatic door opening and closing has been explained; however, it is always possible for the user to open or close the door 20 by hand, which is advantageous in the event that the automatic operation is mal-or non-functioning. For example, when the door 20 is between the open and closed states, the automatic open/close operation can be performed immediately by hand.

The specific situations illustrated and described herein are to be taken as examples only. Various changes beyond the embodiment described may be implemented by those skilled in the art, and are to be understood as forming a part of the present invention insofar as they fall within the spirit and scope of the appended claims.

What is claimed is:

1. A door opening/closing apparatus in a washing machine, the apparatus comprising:

means for sensing an open state of a washing machine door;

means for sensing a closed state of said door;

means for supplying dynamic force to open and close said door;

means triggered by an external key operation for producing a door opening/closing command; and means for determining a state of said door based on information supplied from each of said sensing means when a door opening/closing command is produced, and controlling the activation of said force-supplying means based on a result of the determination.

2. An apparatus according to claim 1, wherein each of said sensing means and command-producing means includes a switch enclosed with a waterproof material.

3. An apparatus according to claim 2, wherein each of said switches is a magnetic switch.

4. An apparatus according to claim 1, wherein said external key is operable by foot.

5. An apparatus according to claim 1, further comprising:

means for warning of an abnormal operation of each of the sensing means.

6. A door opening/closing method for a washing machine having an automatic door mechanism, the method comprising the steps of:

determining whether or not a door opening/closing demand exists;

sensing whether the door is opened or closed if the door opening/closing demand exists;

closing the door by driving a motor in the case when a door opened state is sensed while the door closed state is not sensed; and opening the door by driving the motor in the case when a door opened state is not sensed while the door closed state is sensed.

7. A door opening/closing method according to claim 6, wherein an open state of the door corresponds to a predetermined door position ranGing from a full opening to a partial opening, and a closed state of the door corresponds to a predetermined door position ranging from a full closing to a partial closing.

8. A door opening/closing method according to claim 7, further comprising the steps of:

determining whether the door is presently undergoing an opening/closing operation when a door opening/closing demand is present; and ignoring the opening/closing demand if the door is presently undergoing an opening/closing operation.

9. A door opening/closing method according to claim 8, further comprising the steps of:

warning a user of an occurrence of an abnormal state and interrupting driving the motor if neither opened nor closed states of the door are sensed and the door is not presently undergoing an opening/closing operation in the presence of a opening/closing demand.

10. A door opening/closing method according to claim 7, further comprising the steps of:

warning a user of the occurrence of an abnormal state and interrupting driving the motor if both the opened and closed states of the door are sensed in the presence of a door opening/closing demand.

11. An apparatus for automatically opening and closing a washing machine door, the apparatus comprising:

means for sensing whether the door is open and supplying a door open signal if the door is open;

means for sensing whether the door is closed and supplying a door closed signal if the door is closed;

motor means for supplying dynamic force to open and close the door;

input means for receiving a door actuation command from a user; and control means for determining, in the presence of a door actuation command, whether a door open signal is present, and for controlling the motor means to close the door if the open signal is present;

said control means also determining, in the presence of an input command, whether a closed signal is present, and for controlling the motor means to open the door if a door closed signal is present.

12. The apparatus claimed in claim 11, wherein the means for sensing whether the door is open, means for sensing whether the door is closed, and input means are waterproof switches.

13. The apparatus claimed in claim 12, wherein the switches are reed switches.

14. The apparatus claimed in claim 11, wherein the input means is operable by foot.

15. The apparatus claimed in claim 11, further comprising:

an audible alarm for warning a user of an abnormal state.

16. The apparatus claimed in claim 15, wherein the abnormal state is indicated when both a door open signal and a door closed signal are present when a door actuation command is entered.

17. The apparatus claimed in claim 11, wherein in the event that the motor means is operating when a door actuation command is received, the control means ignores the door actuation command.

18. The apparatus claimed in claim 17, wherein the control means sounds an audible alarm.

* * * * *